US007490589B2

(12) United States Patent
Itagaki

(10) Patent No.: US 7,490,589 B2
(45) Date of Patent: Feb. 17, 2009

(54) ELECTRONICALLY CONTROLLED THROTTLE VALVE UNIT

(75) Inventor: Katsuhiko Itagaki, Hamamatsu (JP)

(73) Assignee: Suzuki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 12/107,565

(22) Filed: Apr. 22, 2008

(65) Prior Publication Data

US 2008/0257308 A1 Oct. 23, 2008

(30) Foreign Application Priority Data

Apr. 23, 2007 (JP) ..... 2007-113134

(51) Int. Cl.
*F02D 9/10* (2006.01)

(52) U.S. Cl. ..... 123/396; 123/399

(58) Field of Classification Search ..... 123/395, 123/396, 399

See application file for complete search history.

(56) References Cited

U.S. PATENT DOCUMENTS 5,423,299 A * 6/1995 Kumagai ..... 123/399
5,429,090 A * 7/1995 Kotchi et al. ..... 123/396
5,752,484 A * 5/1998 Apel et al. ..... 123/396
6,267,352 B1 * 7/2001 Semeyn et al. ..... 251/129.12
6,286,481 B1 * 9/2001 Bos et al. ..... 123/399
6,382,181 B2 * 5/2002 Wayama et al. ..... 123/399
6,575,427 B1 * 6/2003 Rauch et al. ..... 251/69
6,834,639 B2 * 12/2004 Torii ..... 123/396
7,207,313 B2 * 4/2007 Torii ..... 123/396
7,398,760 B2 * 7/2008 Kondo ..... 123/336
2004/0069271 A1 * 4/2004 Kanno et al. ..... 123/396
2005/0087172 A1 * 4/2005 Torii ..... 123/396

FOREIGN PATENT DOCUMENTS

JP 02-030933 2/1990
JP 05-231188 9/1993

* cited by examiner

*Primary Examiner*—Erick Solis
(74) *Attorney, Agent, or Firm*—Barnes & Thornburg LLP

(57) ABSTRACT

An electronically controlled throttle valve unit includes a valve shaft supported by a throttle body, a throttle valve provided on the valve shaft rotatably therewith, an actuator for controlling the valve shaft, and a mechanical valve opening/closing mechanism. The mechanical valve opening/closing mechanism comprises: a valve lever provided on the valve shaft rotatably therewith; a cam lever supported rotatably with respect to the valve shaft so as to be directly operated through a throttle operation; and a link lever supported rotatably by the throttle body and transmitting a rotation of the cam lever in a direction of opening the throttle valve to the valve lever so as to rotate the valve lever and the valve shaft in a throttle valve opening direction with a predetermined rotation angle characteristics.

7 Claims, 7 Drawing Sheets

ELECTRONICALLY CONTROLLED THROTTLE VALVE UNIT

CROSS-REFERENCE TO RELATED APPLICATIONS

This application is an Application based upon and claiming the benefit of priority to Japanese Patent 2007-113134, filed on Apr. 23, 2007, the contents of which are incorporated herein by reference.

BACKGROUND OF THE INVENTION

1. Field of the Invention

The present invention relates to an electronically controlled throttle valve unit for controlling opening/closing (opening and/or closing) operation of throttle valves by an actuator such as an electric motor, particularly, capable of operating a throttle on an emergency by opening/closing the throttle valve through throttle operation of a driver when the actuator is in trouble.

2. Related Art

In recent years, conventional carburetor type fuel supply system of the motorcycle has been replaced by that of fuel injection type, which is more highly efficient. At the same time, the conventional mechanical type throttle unit, which transmits a motion of a throttle grip directly to the throttle valve through a control cable, linkage mechanism or the like, has been replaced by that of electronic control system type, called accelerator-by-wire system, in which a throttle operation amount is once detected by a throttle position sensor, and in accordance with the detected amount, a control computer controls the actuator (such as electric motor) to open/close the throttle valve appropriately.

Concerning such an electronically controlled throttle valve unit, if the actuator, throttle position sensor or control computer is out of order, the electronic control of the throttle valve stops, and then, the throttle valve is closed by a link mechanism provided as a fail-safe mechanism. As a result, thereafter, the vehicle cannot be accelerated, and it is difficult for the vehicle to drive for emergency to breakdown lane or to drive to a repair plant, for example.

Then, Japanese Patent Application Laid-Open Publication No. 2-30933 (Patent Publication 1) and Japanese Patent Application Laid-Open Publication No. 5-231188 (Patent Publication 2) disclose an electronically controlled throttle valve, which allows, at a time of being out of order of the vehicle, driving for emergency by enabling to mechanically open/close the throttle valve within a predetermined range of the throttle valve.

In the electronically controlled throttle valve unit disclosed in the Patent Publication 1, a first clutch and a second clutch are provided on both ends of the throttle valve shaft so as to allow connection/disconnection between the throttle valve shaft and the electric motor (actuator) by the first clutch and allow connection/disconnection between the throttle valve and an accelerator pedal (i.e., gas pedal) by the second clutch. At an ordinal normal control by an electric motor, the first clutch is connected and the second clutch is disconnected, and on the centrally, if abnormality occurs in the electric motor, the first clutch is disconnected and the second clutch is connected to thereby enable driving for emergency by pressing a accelerator pedal even if the abnormality occurs.

In the electronically controlled throttle valve unit disclosed in the Patent Publication 2, a one-way clutch is interposed between the throttle valve shaft and the electric motor, and in an abnormal state of the electric motor, the throttle valve is made operative by disconnecting the throttle valve shaft from the electric motor. A first lever and a second lever are disposed on a side opposite to the electric motor with respect to the throttle valve in a manner such that the first lever is supported on a throttle valve shaft rotatably to be freely swingable by a accelerator pedal cable, and on the other hand, the second lever is provided on the throttle valve shaft rotatably therewith. By interposing a coil spring between the first lever and the second lever, pressing or urging forces are generated in relatively opposite directions to each other.

When the electric motor is out of order and in trouble, the first lever swings corresponding to an operation of the accelerator pedal, a rotation is transmitted through the coil spring to the second lever and then throttle valve shaft is rotated to open the throttle valve. Further, with the structure in which an engaging piece of the second lever is engaged with one side of the first lever, when an operation is performed to close the accelerator pedal, the rotation of the first lever is transmitted to the second lever by the engaging piece and the throttle valve shaft is rotated in a direction of closing the throttle valve.

However, in the electronically controlled throttle valve unit disclosed in the Patent Publication 1, when the actuator is in trouble, connection/disconnection of the first clutch and the second clutch need to be executed, and accordingly, it is necessary to cope with an abnormality in the clutch control system. Therefore, it is hard to say that such electronically controlled throttle valve unit is excellent in certainty and reliability of driving for emergency.

In addition, in the electronically controlled throttle valve unit disclosed in the Patent Publication 2, since the throttle valve shaft is operated in a direction of opening the valve through the coil spring interposed between the first lever and the second lever, there is a fear that a desired valve opening amount may not be achieved due to aging of the coil spring.

Furthermore, the electronically controlled throttle valve units of the Patent Publications 1 and 2 have such a defect that the number of their components is increased, and hence, their structure is made complicated, thus increasing manufacturing cost and easily inducing troubles.

SUMMARY OF THE INVENTION

The present invention was conceived in consideration of the circumstances mentioned above and an object of the invention is to provide an electronically controlled throttle valve unit having a highly durable, simple, inexpensive and compact configuration and structure and capable of opening/closing the throttle valve mechanically according to a driver's intention at a time of trouble of an actuator or the like and having a high setting freedom of the valve opening characteristics, and in addition, at the time of normal operation of the actuator, smooth electronic control of the throttle valve can be achieved.

The above and other objects can be achieved according to the present invention by providing an electronically controlled throttle valve unit including a valve shaft supported by a throttle body, a throttle valve provided on the valve shaft rotatably therewith, an actuator for controlling rotation of the valve shaft, and a mechanical valve opening/closing mechanism, the mechanical valve opening/closing mechanism comprising:

a valve lever provided on the valve shaft rotatably therewith;

a cam lever supported rotatably with respect to the valve shaft so as to be directly operated through a throttle operation; and a link lever supported rotatably by the throttle body and transmitting a rotation of the cam lever in a direction of opening the throttle valve to the valve lever so as to rotate the valve lever and the valve shaft in a throttle valve opening direction with a predetermined rotation angle characteristics.

In the above aspect of the present invention, it may be desired that the cam lever is provided with a cam portion and the link lever is provided with a fulcrum point, a power point and a working point, in which the fulcrum point is supported rotatably on the throttle body, the power point is brought into contact with a cam portion of the cam lever, and the working point is positioned such that when the cam lever is rotated in the direction of opening the throttle valve, the power point of the link lever is pressed by the cam portion, and then, the working point presses a rotation input portion of the valve lever in the direction of opening the throttle valve.

The cam lever may be provided with a pressing portion which presses the rotation input portion of the valve lever directly by the rotation of the cam lever in the direction of closing the throttle valve, thereby forcibly rotating the valve lever in the direction of closing the throttle valve. It may be desired that the rotation input portion of the valve lever is positioned between the pressing portion of the cam lever and the working point of the link lever, and during an operation of the throttle valve to be opened and closed through the throttle valve, the actuator controls the valve shaft so that the rotation input portion of the valve lever is rotated without contacting either the pressing portion or the working point.

It may be further desired that a contact surface at a position that the working point of the link lever and the rotation input portion of the valve lever start to contact each other intersects with a straight line connecting a center of the fulcrum point of the link lever with a center of the valve shaft as viewed in an axial direction of the valve shaft.

The mechanical valve opening/closing mechanism may further comprise a return spring for pressing the valve lever in the direction of closing the throttle valve with respect to the cam lever, the return spring being provided between the cam lever and the valve lever and being formed so as to generate a pressing force in the direction of closing the throttle valve only when the valve lever and the cam lever are positioned in a vicinity of the throttle valve closing position.

It may be also desired that a throttle pulley shaft parallel to the valve shaft may be supported by the throttle body, and a throttle pulley, which is rotated through a throttle operation, may be disposed on the throttle pulley shaft rotatably therewith, the throttle pulley being connected with the cam lever by a link member.

According to the electronically controlled throttle valve unit of the present invention, the mechanical valve opening/closing mechanism is provided, the throttle valve can be opened/closed mechanically according to a driver's intention when the actuator or the like is in trouble, thereby enabling driving for emergency or continuing to drive securely. The mechanical valve opening/closing mechanism has a simple and compact structure, and the setting freedom of the valve opening characteristics can be achieved when the throttle valve is mechanically opened/closed.

If the actuator is in trouble when the throttle valve is opened, the throttle valve can be closed quickly and securely according to the driver's intention. Further, upon the normal operation, the mechanical valve opening/closing mechanism can be prevented from affecting the control of the throttle valve, thereby achieving a smooth throttle valve control.

The nature and further characteristic features of the present invention will be made clearer from the following descriptions made with reference to the accompanying drawings.

DESCRIPTION OF THE PREFERRED EMBODIMENTS

Figure 1:
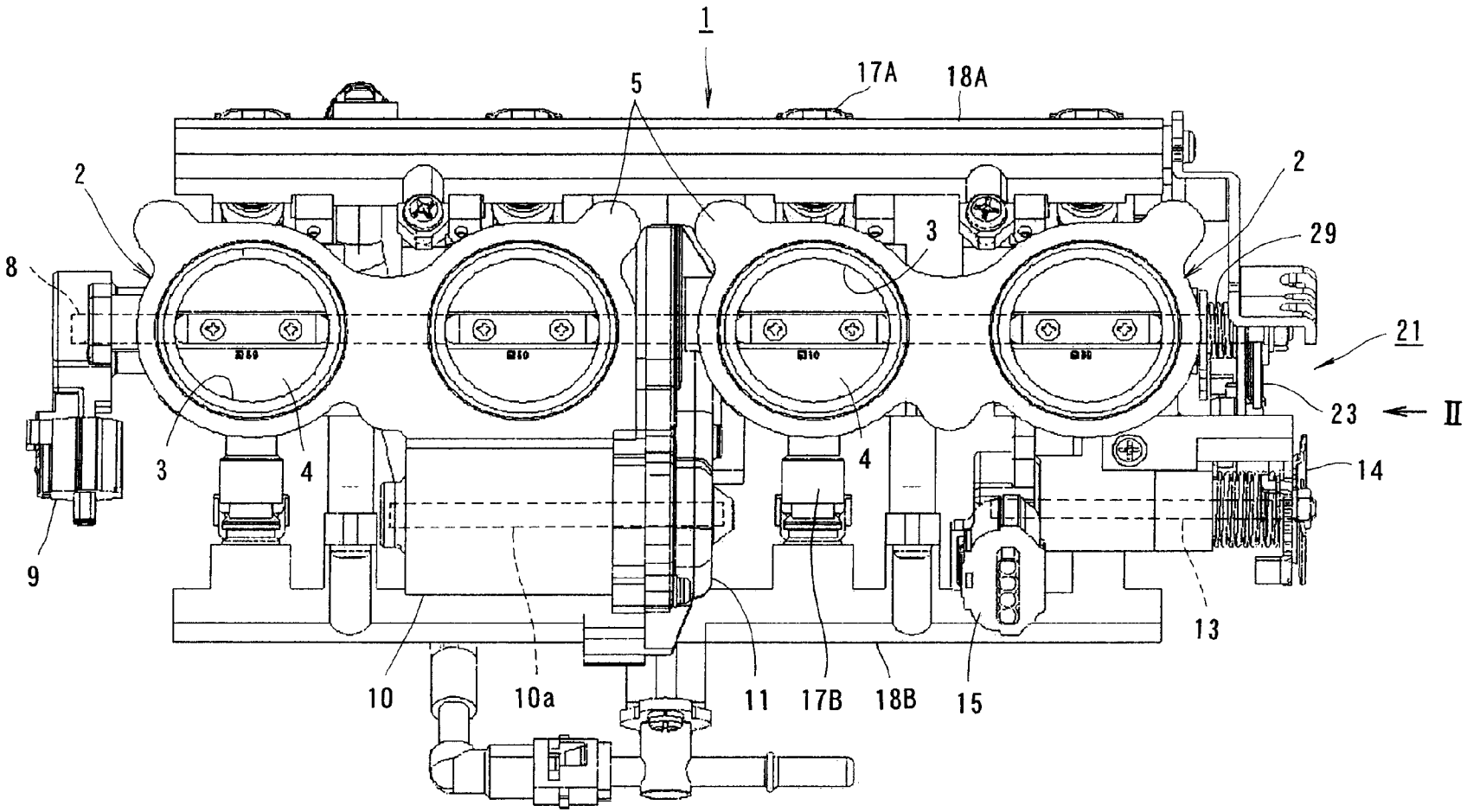
FIG. 1 is a view of an electronically controlled throttle valve unit of the present invention as viewed from an intake side thereof.
Figure 2:
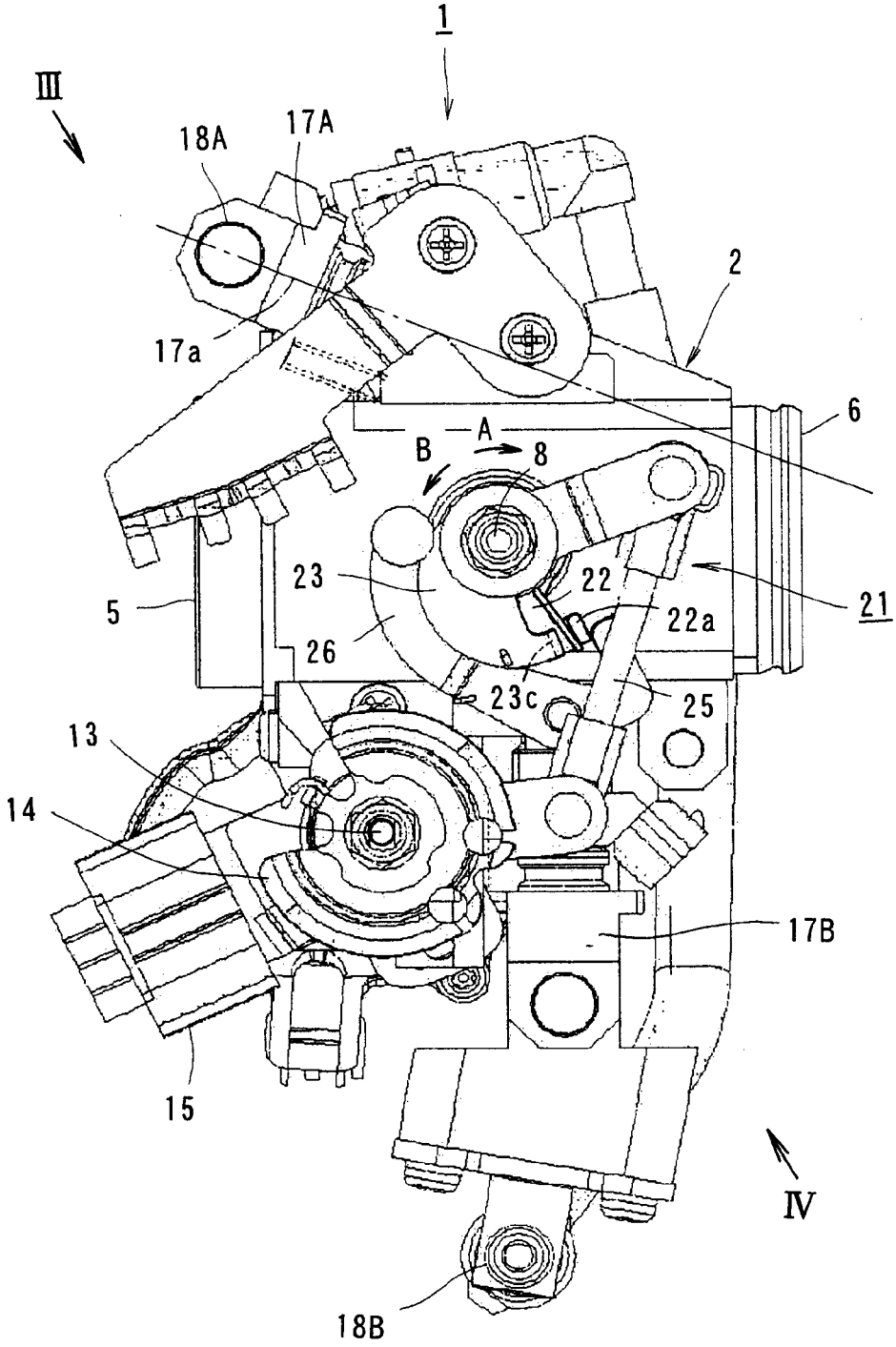
FIG. 2 is a right side view of the electronically controlled throttle valve unit taken in the direction of the arrow II in FIG. 1.
Figure 3:
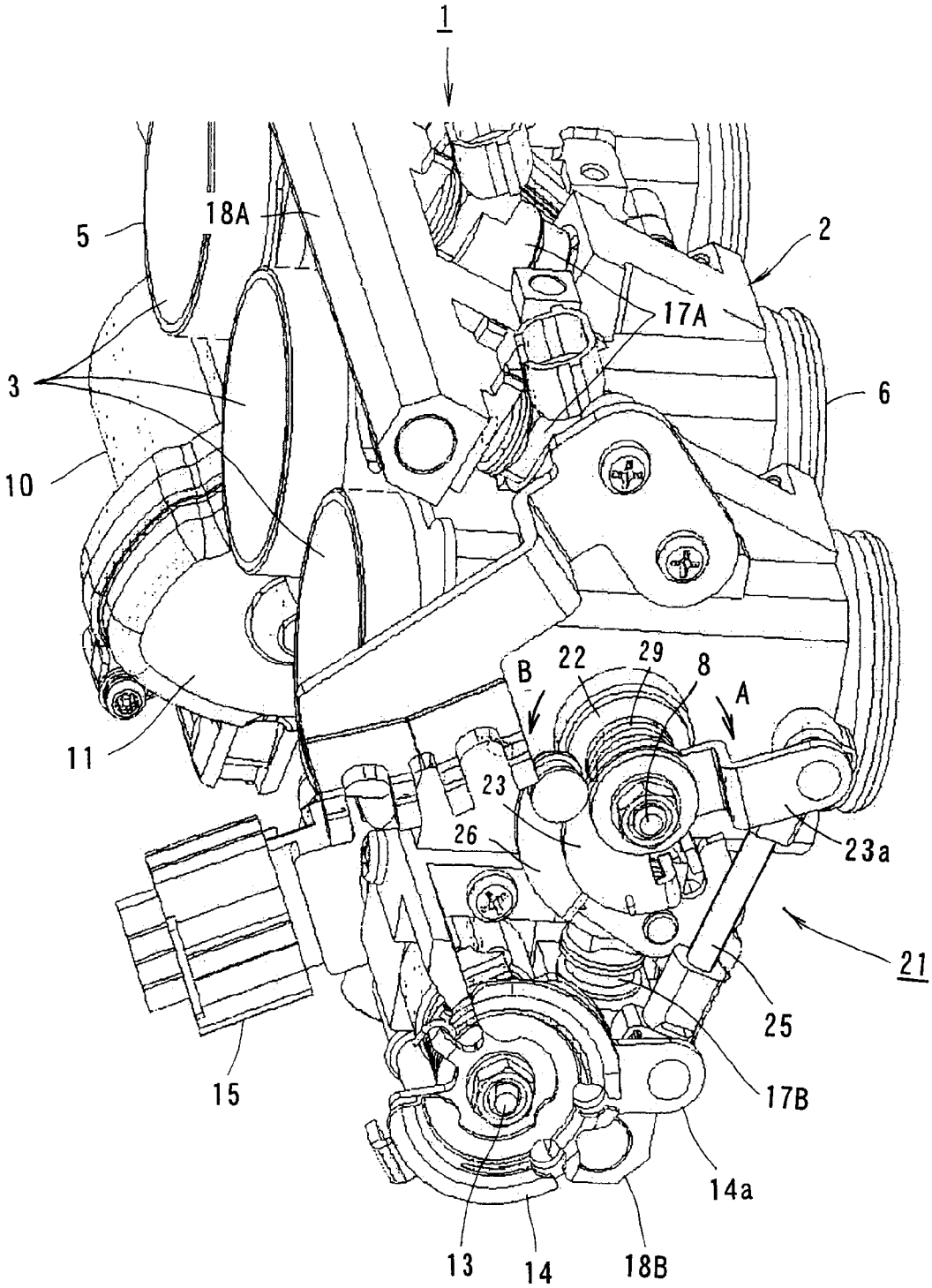
FIG. 3 is a perspective view of the electronically controlled throttle valve unit taken in the direction of the arrow III in FIG. 2.
Figure 4:
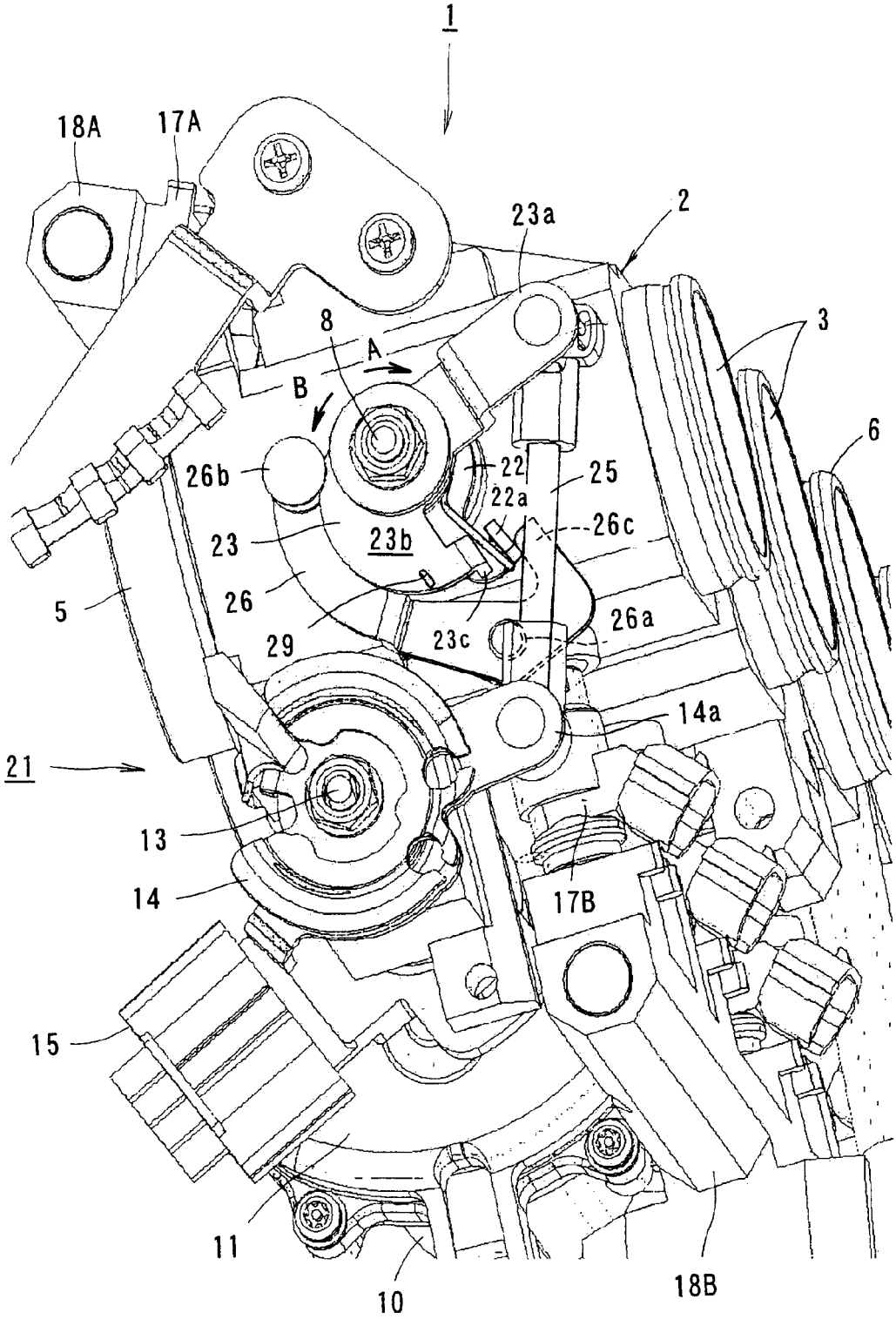
FIG. 4 is a perspective view of the electronically controlled throttle valve unit taken in the direction of the arrow IV in FIG. 2.

Hereinafter, the preferred embodiments of the present invention will be described with reference to the accompanying drawings. Further, it is to be noted that terms "upper", "lower", "right", "left" and like terms are used herein with reference to the illustration of the drawings or in a usual installation state of an equipment including a throttle valve unit.

With reference to FIGS. 1 to 4, an electronically controlled throttle valve unit 1 is installed on, for example, a parallel four-cylinder engine of motorcycle and includes two units of twin throttle body 2 aligned in the vehicle width direction so as to form four throttles. In each throttle body 2, two intake air passages 3 are formed, the four intake air passages 3 are arranged in parallel to each other and a circular throttle valve 4 is provided for each intake air passage 3 in a manner so as to be opened or closed.

A connection flange 5 for connecting to an air cleaner side is formed at an end portion on the upstream side of the throttle body 2 (intake air passage 3), and a union-shaped insertion portion 6 for connecting to an engine side is formed on the end portion of the downstream side.

A valve shaft 8 arranged to intersect with each intake air passage 3 is supported rotatably on the throttle bodies 2 and each throttle valve 4 is fixed to the valve shaft 8 so as to be rotated therewith. Then, all the throttle valves 4 are opened and/or closed in the same opening degree by the rotation of the valve shaft 8. Herein, a valve position sensor 9 for detecting the rotation amount of the valve shaft 8, that is, the opening amount of the throttle valves 4 is provided on the left side surface (side surface on the lower portion of FIG. 1 presented on the paper) of the throttle body 2.

The rotation of the valve shaft 8 is controlled by an electric motor 10 as an actuator. This electric motor 10 is disposed closer to one end side (left side in this embodiment) of the valve shaft 8 and disposed just below the throttle body 2 on one side (left side in this embodiment), for example, in a manner that the axial direction of a main shaft 10*a* is parallel to the valve shaft 8 and the main shaft 10*a* is closely disposed to the shaft 8. A driving power of the electric motor 10 is decelerated by a deceleration gear unit 11 and transmitted to the valve shaft 8.

A throttle pulley shaft 13 is axially supported just below the other throttle body 2 (right side in the embodiment), closer to the other end side (right end side) of the valve shaft 8 so as to be parallel to the valve shaft 8. This throttle pulley shaft 13 and (the main shaft of) the electric motor 10 are substantially coaxially disposed.

A throttle pulley 14 is provided at the outside end portion (right end) of the throttle pulley shaft 13 rotatably therewith and a throttle position sensor 15 is provided at an inside end portion (left end). Herein, the throttle pulley 14 is provided with a rod connecting portion 14*a* extending in a centrifugal direction (diameter direction) with respect to the throttle pulley shaft 13.

Each of the intake air passages 3 is provided with injectors 17A, 17B for fuel injection, and pipe members 18A, 18B for supplying fuel to the injectors 17A, 17B are also disposed in parallel to the valve shaft 8. Four injectors 17A are main injectors and provided on the throttle body 2 in a manner that each central axis 17*a* intersects with an axis of the intake air passage 3 at a shallow angle. Fuel injected from each injector 17A is directed to the downstream side of the throttle valve 4 and inward of the intake air port of the engine.

On the other hand, the other four injectors 17B are sub-injectors capable of injecting fuel at a time when the throttle valve 4 has an intermediate or more opening degree, and the injection direction is set so that the fuel is applied directly to the throttle valve 4 positioned on the intake air downstream side of the valve shaft 8 at the time of the intermediate or more opening degree of the throttle valve 4. This sub-injector 17B is operated to increase the amount of injected fuel when the vehicle is operated under a high load, for example, for acceleration thereof.

The throttle pulley 14 is interlocked with a throttle grip of a motorcycle through a throttle cable, not shown, and when a rider of the motorcycle turns the throttle grip, the throttle pulley 14 is rotated and the amount of the rotation is detected by the throttle position sensor 15, and a control computer, not shown, controls the electric motor 10 depending on the opening degree and opening speed (change rate of throttle valve opening degree) of the throttle valve 4 so as to open and/or close the throttle valve 4 appropriately depending on the engine speed, vehicle speed, shift condition and the like.

At the same time, the fuel injection amount from the injectors 17A, 17B and injection timing are set to be optimum. Herein, an actual opening amount of the throttle valve 4 is detected by the valve position sensor 9 and fed back to the control computer.

Figure 5:
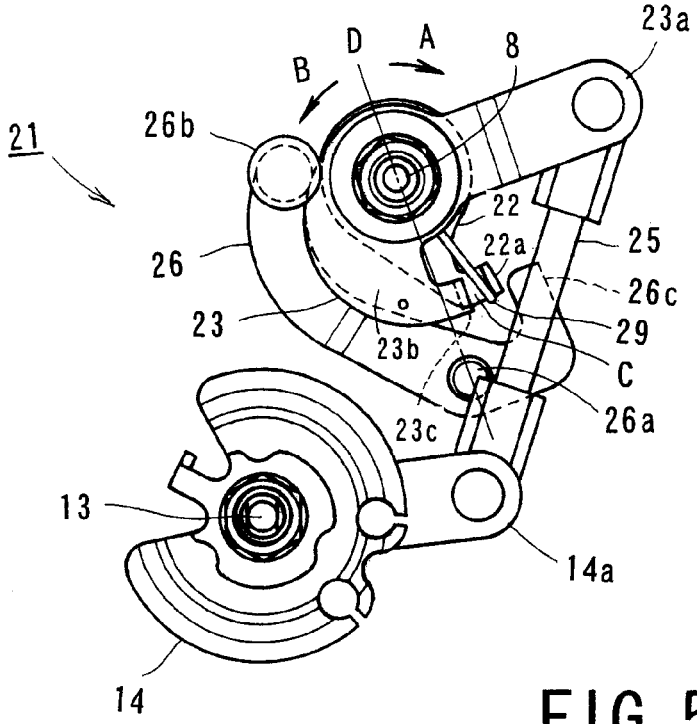
FIG. 5 is a right side view of a mechanical valve opening/closing mechanism in a state that a valve lever and a cam lever are located close to a throttle valve closing position.

As shown in FIG. 5, the electronically controlled throttle valve unit 1 is provided with a mechanical valve opening/closing mechanism 21. This mechanical valve opening/closing mechanism 21 is provided on the right side surface of the throttle body 2 on the right side and configured to include the above-mentioned throttle pulley shaft 13 and the throttle pulley 14 as follows.

A valve lever 22 is provided on the right end of the valve shaft 8 to be rotatable therewith. This valve lever 22 is formed from a plate material into a lever-shape, for example, and the front end of the lever is bent at right angle to form a rotation input portion 22*a*.

Similarly, a cam lever 23 made of metal plate is provided on the right end of the valve shaft 8 so as to be overlapped on the outside of the valve lever 22. This cam lever 23 is supported rotatably with respect to the valve shaft 8, and a lever-like rod connecting portion 23*a* extending in a centrifugal direction (diameter direction) from the valve shaft 8 and a cam portion 23*b* are formed thereon. The cam portion 23*b* is formed so as to provide a circular arc cam configuration, and the radius of the cam portion increases as the cam lever 23 is rotated in an opening direction A of the throttle valve 4.

Further, an end portion of the cam portion 23*b* is bent to form a pressing portion 23*c* such that the pressing portion 23*c* is positioned on a side in a direction of rotating the throttle valve 4 (valve opening direction A) so as to open the valve with respect to the rotation input portion 22*a* of the valve lever 22. Therefore, if the control system is in trouble when the throttle valve 4 is opened, the cam lever 23 is rotated in a closing direction B of the throttle valve 4 by a throttle operation by a rider, and the pressing portion 23*c* presses the rotation input portion 22*a* directly so as to force the valve lever 22 to mechanically rotate in the valve closing direction B.

When the throttle valve 4 is closed, for example, upon idling, a predetermined gap C is formed between the rotation input portion 22*a*and the pressing portion 23*c*. This gap C is set to provide a size which allows the valve lever 22 to rotate slightly in the valve opening direction A. Thus, the throttle valve 4 can be opened slightly to enable fast idle control and idling speed control smoothly at the time of the steady (normal) operation in which the electric motor 10 is not in trouble. In the fast idle control or idling speed control at the time of cold start, the engine speed can be automatically optimized by driving the electric motor 10 by a control computer under a condition without rider's throttle operation.

The front end of the rod connecting portion 23*a* of the cam lever 23 and the front end of the rod connecting portion 14*a* of the throttle pulley 14 are connected together through a link rod 25 (link member), and accordingly, the cam lever 23 can be rotated arbitrarily by rider's throttle operation.

A link lever 26 is supported rotatably on the right side surface of the right side throttle body 2 just under the valve shaft 8. This link lever 26 is made of metal plate and formed into a substantially J-shaped lever having a fulcrum point 26*a*, a power point 26*b* and a working point 26*c*. The fulcrum point 26*a* serves as a shaft supporting portion, and the power point 26*b* and the working point 26*c* are positioned on both sides of the supporting point 26*a*.

A section from the fulcrum point 26*a* to the power point 26*b* is curved along the outer peripheral shape of the cam portion 23*b* of the cam lever 23, and the power point 26*b*, which is a front end, is formed into a roller-shape or slider-shape. This power point 26*b* makes contact with the outer peripheral portion of the cam portion 23*b* and slides along the cam shape. On the other hand, the working point 26*c* is positioned on the side in the valve closing direction B with respect to the rotation input portion 22*a* of the valve lever 22.

Thus, if the control system is in trouble, when a rider turns the throttle grip of a motorcycle in a direction of opening the throttle valve 4, the throttle pulley 4 is rotated and the rotation is transmitted to the cam lever 23 through a link rod 25 so as to rotate the cam lever 23 in the valve opening direction A. Thus, the cam portion 23*b* of the cam lever 23 is rotated, the power point 26*b* of the link lever 26 in contact with the periphery of the cam portion 23*b* is pressed by the cam portion 23*b* so that the working point 26*c* of the link lever 26 presses the rotation input portion 26*b* of the valve lever 22 to thereby rotate the valve lever 22 in the valve opening direction A. Thus, the throttle valve 4 is forced to open mechanically.

In this way, the link lever 26 serves to transmit a rotation of the cam lever 23 in the valve opening direction A to the valve lever 22 so as to rotate the valve lever 22, the valve shaft 8 and the throttle valve 4 in the valve opening direction A. The maximum opening degree of the throttle valve 4 at this time is set to a minute opening degree (for example, about 10°). Thus, there obtains an output of an extent capable of performing the driving operation for emergency while the rider clearly feels an abnormality.

The cam lever 23 is provided with a return spring 29, which is wound around the valve shaft 8, for example, and one end thereof is engaged with the cam portion 23*b* of the cam lever 23 while the other one end abuts against the rotation input portion 22*a* of the valve lever 22 on the valve opening direction A side.

Although the return spring 29 urges and pushes the valve lever 22 backward in the valve closing direction B with respect to the cam lever 23, it this pushing force is soft so as to improve the operating feeling of the valve lever 22 only when the rotation input portion 22*a* of the valve lever 22 and the pressing portion 23*c* of the cam lever 23 approach each other in a minute relative angle as shown in a state of FIG. 5. When the control system is in trouble, as described before, the valve lever 22 is forced to be rotated mechanically in the valve opening direction through the throttle operation of the rider.

Although the pressing portion 23*c* of the cam lever 23 cannot be rotated further in the valve closing direction B when the throttle pulley 14 is rotated up to its fully closed position, the valve lever 22 can be pushed back by a predetermined angle by a pressing or urging force of the return spring 29. Therefore, the throttle valve 4 can be returned to its fully closed position (i.e., idling state).

Figure 6:
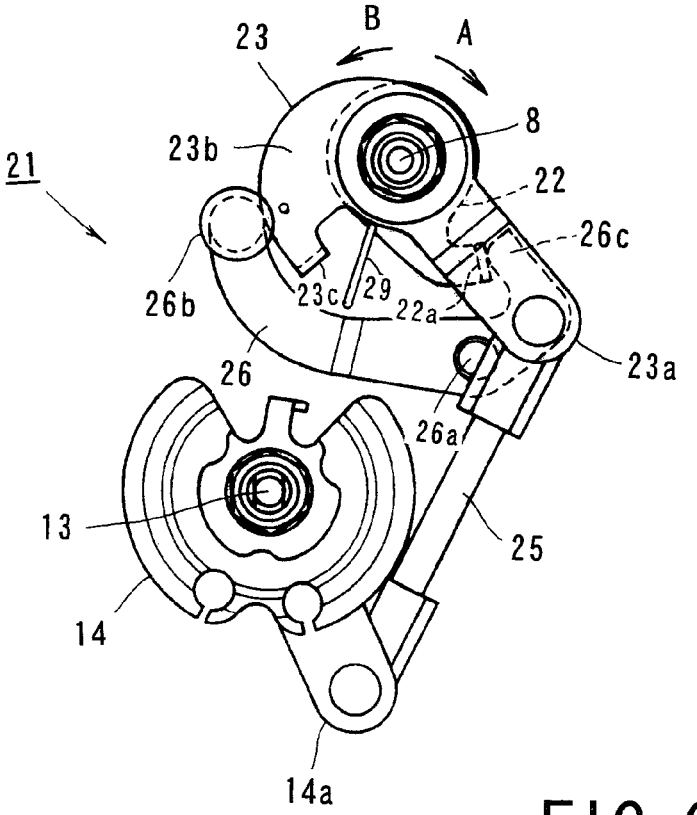
FIG. 6 is a right side view of the mechanical valve opening/closing mechanism in a state that the valve lever and the cam lever are not located close to the throttle valve closing position.

On the other hand, when the rotation input portion 22*a* of the valve lever 22 and the pressing portion 23*c* of the cam lever 23 are not positioned in a predetermined minute relative angle as shown in a state of FIG. 6, the return spring 29 takes its free state so that the return spring 29 is apart from the rotation input portion 22*a* of the valve lever 22. As a result, upon forcing the valve lever 22 to open mechanically when the control system is in trouble, the pressing force of the return spring 29 is not applied to the valve lever 22.

Figure 7:
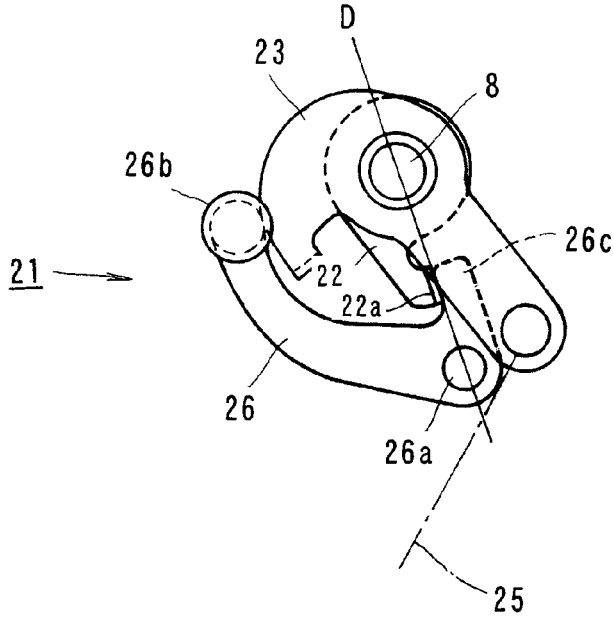
FIG. 7 is a right side view showing a modification in which a point where a link lever action point and valve lever rotation input portion start to contact is disposed on a straight line connecting a fulcrum point with a valve shaft taken in the axial direction of the valve shaft.

In the meantime, it is preferred that a point at which the working point 26*c* of the link lever 26 and the rotation input portion 22*a* of the valve lever 22 start to contact each other is positioned in the vicinity of a straight line D connecting the fulcrum point 26*a* and the valve shaft 8 taken in the axial direction of the valve shaft 8. As an optimum embodiment, the point may be disposed on the straight line D as shown in FIG. 7. Accordingly, the amount of friction between the working point 26*c* and the rotation input portion 22*a* is minimized when the working point 26*c* presses the rotation input portion 22*a*, thereby preventing wearing of the both the input portion 22*a* and the point 26*c* to improve the durability of the mechanical valve opening/closing mechanism 21.

In the electronically controlled throttle valve unit 1 provided with such mechanical valve opening/closing control mechanism 21, at the time of the normal operation in which the opening/closing control of the throttle valve 4 by the electric motor 10 as an actuator is performed normally, a throttle grip operation amount of the rider is detected by the throttle position sensor 15, and depending on the detected signal, the control computer controls the electric motor 10 so as to electrically open/close the throttle valve 4.

Figure 8:
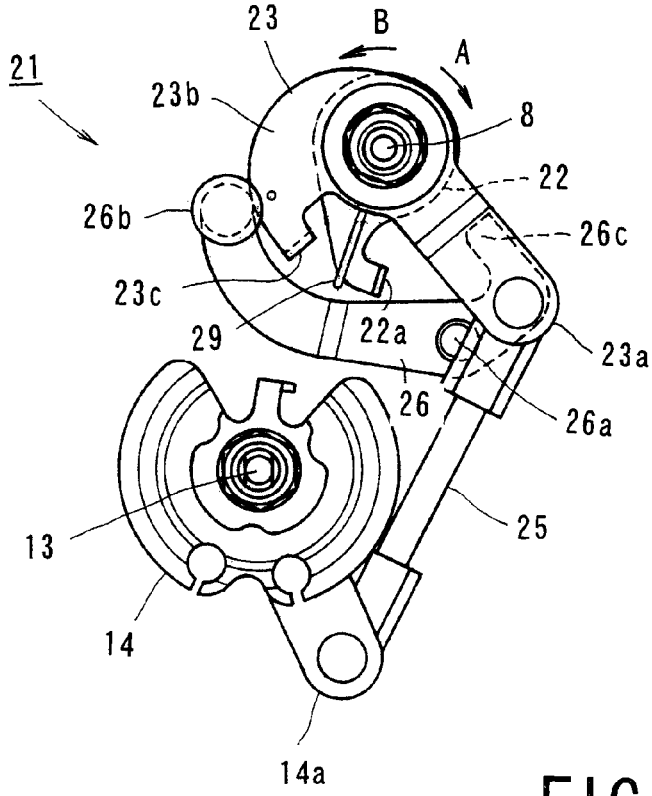
FIG. 8 is a right side view showing a state of the mechanical valve opening/closing mechanism at a time of normal operation in which the opening/closing control of the throttle valve by the actuator is performed normally.

Although, even in such normal operation, the cam lever 23 is rotated through the transmission from the link rod 25 as shown in FIG. 8, the control computer controls the throttle valve 4 (electric motor 10) to keep the rotation input portion 22*a* of the valve lever 22 between the pressing portion 23*c* of the cam lever 23 and the working point 26*c* of the link lever 26 without contacting both the pressing portion 23*c* and the working point 26*c*. As a result, in the normal operation, the mechanical valve opening/closing mechanism 21 is prevented from affecting control of the throttle valve 4, thus achieving the smooth throttle valve control. Particularly, the idle speed control and fast idling control can be executed at high precision.

When the throttle valve 4 is opened at a high opening degree in the normal operation, the return spring 29 departs from the rotation input portion 22*a* of the valve lever 22. The, the valve lever 22, the valve shaft 8 and the throttle valve 4 can be operated smoothly without being affected by the pressing or urging force of the return spring 29.

On the other hand, if the throttle valve 4 cannot be opened/closed electrically due to a trouble of the electric motor 10, the rider operates the grip so as to control the control computer so that the throttle valve 4 is forcibly opened by the operation of the throttle pulley 14, the link rod 25, the cam lever 23, the link lever 26 and the valve lever 22 of the mechanical valve opening/closing mechanism 21, and thus, the vehicle can drive securely for emergency or continue to drive though the valve opening amount is small.

The rotation angle characteristics of the throttle valve 4 (valve lever 22), when the throttle valve 4 is forced to open by the mechanical valve opening/closing mechanism 21, can be set arbitrarily by setting a shape of the cam portion 23*b* of the cam lever 23, distances of the power point 26*b* and the working point 26*c* with respect to the fulcrum point 26*a* of the link lever 26, that is, a lever ratio appropriately, which allows high setting freedom.

Figure 9:
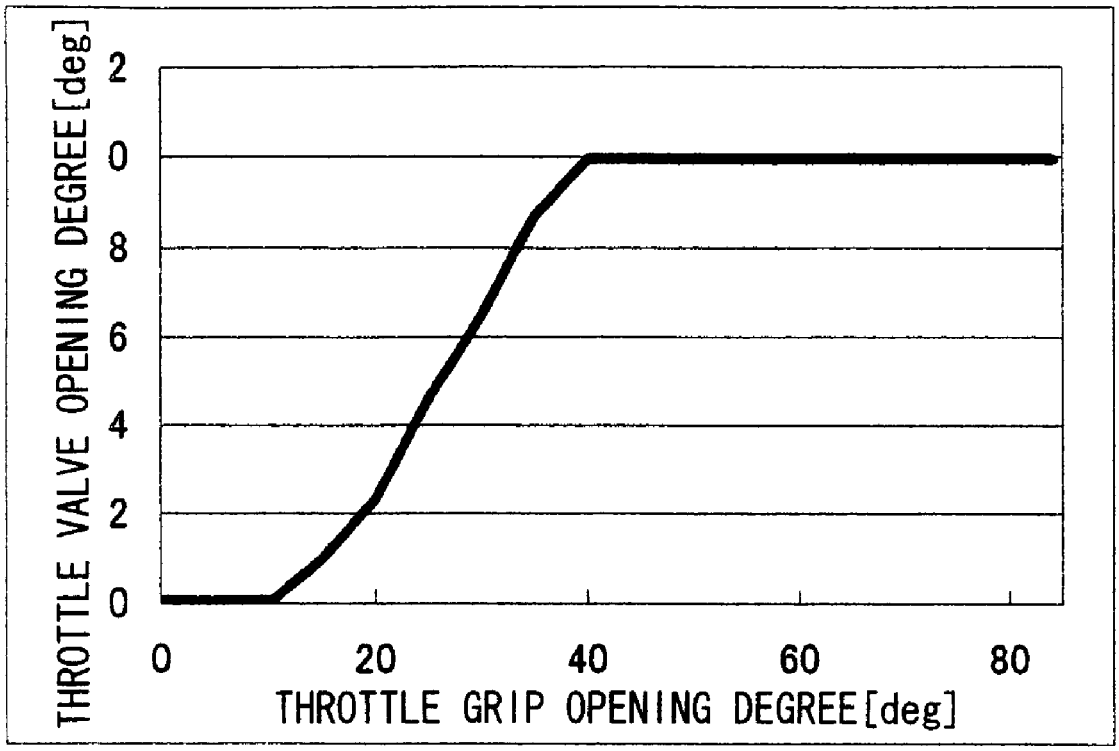
FIG. 9 is a diagram showing the relationship between the throttle grip opening and throttle valve opening when the throttle valve is opened forcibly by the mechanical valve opening/closing mechanism.

Preferably, as shown in FIG. 9, the shapes of the cam portion 23*b*of the cam lever 23 and the link lever 26 (lever ratio of the power point 26*b* and the working point 26*c* with respect to the fulcrum point 26*a*) are set such that the throttle valve is relatively quickly opened up to an opening degree about several percents of the full opened degree while the throttle grip opening degree by the rider is small, and after that, even if the throttle grip opening degree is increased, the opening degree of the throttle valve is maintained constant.

The reason of the above setting is to prevent the rider from turning the throttle grip largely when the electronically controlled throttle valve unit 1 is in trouble. This can avoid a case that any unexpected acceleration, because the rider turns the throttle grip largely, is induced when the abnormal condition is recovered naturally (suddenly).

The throttle valve opening degree indicated on the ordinate axis in FIG. 7 is a detection value of the valve position sensor 9 and the throttle grip opening degree indicated on the abscissa axis is a detection value of the throttle position sensor 15. As can be seen from the figure, when the throttle grip opening degree is from 0 to about 10 degrees, the throttle valve is not opened. This is caused by a gap provided between the working point 26*c* of the link lever 26 and the rotation input portion 22*a*, and the size of the gap can be arbitrarily set.

On the other hand, when the motorcycle is driving normally with the throttle valve 4 opened, even if the electric motor 10 or the like is in trouble, by turning back the throttle grip, the cam lever 23 is rotated in the valve closing direction B together with the throttle pulley 14, and the pressing portion

23*c* of the cam lever 23 comes into contact with the rotation input portion 22*a* of the valve lever 22 to forcibly push back the valve lever 22, the valve shaft 8 and the throttle valve 4 in the valve closing direction B. Thus, the throttle valve 4 can be closed quickly and securely according to a rider's intention so as to reduce engine output.

When the throttle valve 4 is opened at a high opening degree, since the return spring 29 is apart from the rotation input portion 22*a* of the valve lever 22, even if the electric motor 10 or the like is in trouble at the intermediate or higher speed operation, the valve lever 22 is never pushed back in the valve closing direction B by the pressing force of the return spring 29, and thus, the motorcycle is never decelerated suddenly against the rider's intention.

According to the mechanical valve opening/closing mechanism 21, the valve opening characteristics at the time, when the throttle valve 4 is opened mechanically, can be arbitrarily configured by changing the cam shape of the cam lever 23, the lever ratio of the link lever 26 or the like, and thus, it can be easily fitted according to an engine output and other specifications.

Furthermore, since the mechanical valve opening/closing mechanism 21 has a very simple structure essentially constituting of the valve lever 22, the cam lever 23 and the link lever 26, it can be installed at a low cost, compactly with a light weight, and particularly, its installation width is as small as several tens mm, thus being preferable for the motorcycle having restrictions in location space.

Particularly, the throttle pulley shaft 13 parallel to the valve shaft 8 is supported by the throttle body 2, and the throttle pulley 14, which is disposed on the throttle pulley shaft 13 rotatably therewith, and the cam lever 23 are connected through the link rod 25, so that the mechanical valve opening/closing mechanism 21 can be made compact.

Still furthermore, two units of the throttle bodies 2 including a plurality of the throttle valves 4 in parallel are aligned in the vehicle width direction so as to be disposed closer to one end side and the other end side of the valve shaft 8, and the electric motor 10 and the throttle pulley shaft 13 are disposed, respectively. In addition, the electric motor 10 and the throttle pulley shaft 13 are substantially coaxially disposed. According to such arrangement, the entire electronically controlled throttle valve unit 1 can be made compact.

It is to be noted that the present invention is not limited to the described embodiment and many other changes and modifications may be made without departing the scope of the appended claims.

What is claimed is:

1. An electronically controlled throttle valve unit including a valve shaft supported by a throttle body, a throttle valve provided on the valve shaft rotatably therewith, an actuator for controlling rotation of the valve shaft, and a mechanical valve opening/closing mechanism, the mechanical valve opening/closing mechanism comprising:

a valve lever provided on the valve shaft rotatably therewith;

a cam lever supported rotatably with respect to the valve shaft so as to be directly operated through a throttle operation; and a link lever supported rotatably by the throttle body and transmitting a rotation of the cam lever in a direction of opening the throttle valve to the valve lever so as to rotate the valve lever and the valve shaft in a throttle valve opening direction with a predetermined rotation angle characteristics.

2. The electronically controlled throttle valve unit according to claim 1, wherein the cam lever is provided with a cam portion and the link lever is provided with a fulcrum point, a power point and a working point, in which the fulcrum point is supported rotatably on the throttle body, the power point is brought into contact with a cam portion of the cam lever, and the working point is positioned such that when the cam lever is rotated in the direction of opening the throttle valve, the power point of the link lever is pressed by the cam portion, and then, the working point presses a rotation input portion of the valve lever in the direction of opening the throttle valve.

3. The electronically controlled throttle valve unit according to claim 2, wherein the cam lever is provided with a pressing portion which presses the rotation input portion of the valve lever directly by the rotation of the cam lever in the direction of closing the throttle valve, thereby forcibly rotating the valve lever in the direction of closing the throttle valve.

4. The electronically controlled throttle valve unit according to claim 3, wherein the rotation input portion of the valve lever is positioned between the pressing portion of the cam lever and the working point of the link lever, and during an operation of the throttle valve to be opened and closed through the actuator, the actuator controls the valve shaft so that the rotation input portion of the valve lever is rotated without contacting either the pressing portion or the working point.

5. The electronically controlled throttle valve unit according to claim 2, wherein a contact surface at a position that the working point of the link lever and the rotation input portion of the valve lever start to contact each other intersects with a straight line connecting a center of the fulcrum point with a center of the valve shaft as viewed in an axial direction of the valve shaft.

6. The electronically controlled throttle valve unit according to claim 1, wherein the mechanical valve opening/closing mechanism further comprises a return spring for pressing the valve lever in the direction of closing the throttle valve with respect to the cam lever, the return spring being provided between the cam lever and the valve lever and being formed so as to generate a pressing force in the direction of closing the throttle valve only when the valve lever and the cam lever are positioned in a vicinity of the throttle valve closing position.

7. The electronically controlled throttle valve unit according to claim 1, wherein a throttle pulley shaft parallel to the valve shaft is supported by the throttle body, and a throttle pulley, which is rotated through a throttle operation, is disposed on the throttle pulley shaft rotatably therewith, the throttle pulley being connected with the cam lever by a link member.

* * * * *